US010386158B2

(12) United States Patent
Kind et al.

(10) Patent No.: US 10,386,158 B2
(45) Date of Patent: Aug. 20, 2019

(54) LIGHT SOURCE WITH A GAS-TIGHT HOLLOW BODY

(71) Applicant: mb-microtec ag, Niederwangen bei Bern (CH)

(72) Inventors: Hannes Kind, Bern (CH); Pascal Knoepfel, Bern (CH)

(73) Assignee: mb-microtec ag, Niederwangen bei Bern (CH)

( * ) Notice: Subject to any disclaimer, the term of this patent is extended or adjusted under 35 U.S.C. 154(b) by 97 days.

(21) Appl. No.: 15/545,537

(22) PCT Filed: Feb. 4, 2016

(86) PCT No.: PCT/EP2016/052368

§ 371 (c)(1),
(2) Date: Jul. 21, 2017

(87) PCT Pub. No.: WO2016/124686

PCT Pub. Date: Aug. 11, 2016

(65) Prior Publication Data

US 2018/0010886 A1 Jan. 11, 2018

(30) Foreign Application Priority Data

Feb. 4, 2015 (AT) ..... A 50087/2015

(51) Int. Cl.
*F41G 1/34* (2006.01)
*F21V 17/10* (2006.01)
(Continued)

(52) U.S. Cl.
CPC ..... *F41G 1/345* (2013.01); *F21V 17/105* (2013.01); *F21V 17/12* (2013.01); *F21V 17/16* (2013.01);
(Continued)

(58) Field of Classification Search
CPC ... F41G 1/32; F41G 1/34; F41G 1/345; F41G 1/35; F21V 17/105; F21V 17/12;
(Continued)

(56) References Cited

U.S. PATENT DOCUMENTS 4,020,203 A * 4/1977 Thuler ..... F41G 1/32 250/458.1
6,122,833 A * 9/2000 Lorocco ..... F41G 1/32 42/132
(Continued)

FOREIGN PATENT DOCUMENTS

CN 102165358 A 8/2011
CN 102812324 A 12/2012
WO 2011/067291 A1 6/2011

OTHER PUBLICATIONS

International Search Report of PCT/EP2016/052368, dated Mar. 3, 2016.

*Primary Examiner* — Alan B Cariaso
(74) *Attorney, Agent, or Firm* — Collard & Roe, P.C.

(57) ABSTRACT

A light source (1), which has a hollow body (2) closed in a gas-tight manner, which is coated on at least one inner side with a phosphor and is filled with gaseous tritium and emits colored light, the hollow body (2) being arranged in a housing (3) of the light source (1), the light source (1) having at least one body (4) of a colored material which annularly encircles a longitudinal center axis of the light source (1) and the color of which is different from black in daylight, the annularly encircling body (4) being arranged at least on a terminal end region of the housing (3) or at least between the terminal end region of the housing (3) and a light-emitting end face of the hollow body (2).

42 Claims, 11 Drawing Sheets

(51) Int. Cl.

| | |
|---|---|
| ***F21V 17/12*** | (2006.01) |
| ***F21V 17/16*** | (2006.01) |
| ***H01J 61/12*** | (2006.01) |
| ***H01J 61/35*** | (2006.01) |
| ***H01J 61/40*** | (2006.01) |

(52) U.S. Cl.
CPC ..... *H01J 61/12* (2013.01); *H01J 61/35* (2013.01); *H01J 61/40* (2013.01)

(58) Field of Classification Search
CPC . F21V 17/16; H01J 61/12; H01J 61/35; H01J 61/40
See application file for complete search history.

(56) References Cited

U.S. PATENT DOCUMENTS

| | | | | |
|---|---|---|---|---|
| 6,367,189 | B1 | 4/2002 | Clay | |
| 8,579,450 | B2 | 11/2013 | Profos | |
| 8,677,674 | B2 | 3/2014 | Glimpse et al. | |
| 9,335,165 | B2 * | 5/2016 | Profos | F41G 1/345 |
| 2002/0166278 | A1 * | 11/2002 | Carlson | F41G 1/345 42/132 |
| 2009/0013581 | A1 | 1/2009 | Lorocco | |
| 2010/0088944 | A1 | 4/2010 | Callihan | |
| 2012/0151817 | A1 | 6/2012 | Howe et al. | |
| 2012/0236484 | A1 | 9/2012 | Miyake | |

* cited by examiner

LIGHT SOURCE WITH A GAS-TIGHT HOLLOW BODY

CROSS REFERENCE TO RELATED APPLICATIONS

This application is the National Stage of PCT/EP2016/052368 filed on Feb. 4, 2016, which claims priority under 35 U.S.C. § 119 of Austrian Application No. A 50087/2015 filed on Feb. 4, 2015, the disclosure of which is incorporated by reference. The international application under PCT article 21(2) was not published in English.

The invention relates to a light source, which has a hollow body closed in a gas-tight manner, which is coated on at least one inner side with a phosphor and is filled with gaseous tritium and emits light, the hollow body being arranged in a housing of the light source.

The invention also relates to a sighting device with a holder for a light source. Light sources of the type mentioned at the beginning are often used in sighting devices, where they are used for example for providing a rear sight and/or a front sight.

Good perceptibility of the rear sight and the front sight, which are usually both produced from blackened metal, is usually ensured during daytime by a bright colored ring (white, green, orange, . . . ). At night, the perceptibility of the rear sight and the front sight is ensured by the light-emitting end faces of the light source. In twilight conditions, a seamless transition between the two functional modes described above, the colored rings and the points of light, takes place.

To provide the ring, the bright color is usually applied manually around a holder of the light source, which however may lead to a considerable amount of time being spent in the production of a sight.

U.S. Pat. No. 8,677,674 B2 discloses an aiming device which has a rear sight and a front sight. Two self-lighting light sources are fitted in the rear sight, a region around the light-emitting lighting means being formed in a dark color, in particular black, in order to attenuate emitted light and not distract from the view of the front sight, which likewise contains a light source. Here, the front sight has a bore, in which the light source is fitted. The front part of the bore, as seen in the viewing direction of the shooter, is concavely formed and provided with a bright color. As a result, a reflection of the light emitted by the light source of the front sight is produced, whereby the visibility of the front sight is intended to be improved.

US 2010/088944 A1 discloses an aiming device in which a photoluminescent color is applied in an annular depression of a holder for a light source of the type mentioned at the beginning that is mounted on a weapon. This is intended to achieve the effect that either the light source itself (in poor ambient light conditions) or the photoluminescent color (in bright ambient light) is visible.

A problem addressed by the invention is that of overcoming the aforementioned disadvantages of the prior art and making it possible for a circular ring to be represented in a form that is easily perceptible in daylight and twilight and making it possible for the end face of the hollow body that appears as a central, light-emitting point to be easily visible at nighttime and twilight.

This problem is solved according to the invention with a light source of the type mentioned at the beginning by the light source having at least one body of a colored material which annularly encircles a longitudinal center axis of the light source and the color of which is different from black in daylight, the annularly encircling body being arranged at least on a terminal end region of the housing or at least between the terminal end region of the housing and at least one light-emitting end face of the hollow body, so that, in a plan view of the annularly encircling body and the hollow body along the longitudinal center plane of the light source, the end face of the hollow body appears as a bright, central point, which is surrounded by a colored ring, the colored ring being formed by an end face of the annularly encircling body that is facing away from the end face of the hollow body.

The solution according to the invention makes it possible to dispense with a laborious subsequent application of a colored ring in the production of the sighting device by integrating the colored ring in the light source.

Preferably, the annularly encircling body is produced from a white, red, yellow, green, blue, orange or violet colored material. In addition, the material of the annularly encircling body may have fluorescent and/or phosphorescent molecules. Thus, the material of the annularly encircling body may for example consist of polymethylmethacrylate, embedded in which are molecules that for example fluoresce or are excited to a phosphorescent state when exposed to ambient light.

The intensity of the emitted light can be increased by the housing having on its inner side a highly reflective coating, in particular a mirroring, and/or the hollow body having on its outer side a highly reflective coating, in particular mirroring, facing the interior of the hollow body.

In order to protect the hollow body, the light source may have at least one protective covering of a transparent material, by which the at least one light-emitting end face of the hollow body is covered.

According to a preferred embodiment of the invention, it may be provided that the annularly encircling body covers a peripheral region of the light-emitting end face of the hollow body, a central region of the light-emitting end face being visible through a clear cross section of the annularly encircling body. This embodiment of the invention is distinguished by a compact construction, the annularly encircling body being able to serve at the same time for fixing the hollow body and/or for protecting the hollow body. At the same time, the annularly encircling body may also be illuminated by the hollow body, so that the visibility of the colored circle produced by the annularly encircling body is improved.

According to a variant of the invention which is distinguished by a particularly simple construction and low-cost production, it may be provided that the annularly encircling body is printed on the protective covering or on the light-emitting end face of the hollow body or on the housing.

A particularly reliable and secure fastening of the hollow body in the housing of the light source can be achieved by the annularly encircling body being part of a holding cage in which the hollow body is arranged, the holding cage being connected to an inner side of the housing.

According to an advantageous development of the invention, it may be provided that the annularly encircling body is part of a holder by which the protective covering is held in the housing.

Furthermore, a peripheral region of a surface of the protective covering that is facing away from the hollow body may lie against the annularly encircling body and be covered by it.

According to a further variant of the invention, it may be provided that the annularly encircling body is connected to or formed in one piece with a tubular portion projecting perpendicularly from it, the protective covering having side surfaces in the form of a cylindrical body, which are connected to the tubular portion projecting perpendicularly from the annular body.

Good fixing of the protective covering in the housing can be provided in an easy way by the annularly encircling body being arranged on an outer side of the housing and connected to the housing by a press fit, the protective covering being clamped in the housing by means of the annular body.

Reliable securement of the protective covering against unwanted slipping can be achieved by there being arranged in the housing at least one holding element, which has a free end projecting into the interior of the housing and an end connected to the housing, the free end of the at least one holding element facing a surface of the protective covering that is facing the hollow body or lying against said surface.

It has been found to be particularly advantageous with regard to easy mounting and positioning of the protective covering on the housing if the at least one holding element is formed as a resilient tongue. The protective covering can be pressed against the annularly encircling body and held in the housing by the force exerted by the resilient tongue.

Reliable holding of the protective covering in the housing can also be achieved by the protective covering having on its lateral peripheries holding portions in the form of clearances or extensions and the housing likewise having on its inner side holding portions in the form of clearances or extensions, the holding portions of the protective covering and the holding portions of the housing engaging in one another.

An embodiment which is distinguished by a simple construction may consist for example in that the housing has at least one encircling clearance, which receives a lateral body surface of the protective covering.

In order to provide securement of the protective covering against falling out of the housing, the housing may have in a region of the terminal end region at least one peripheral region projecting in the direction of the longitudinal center line.

Advantageously, the hollow body may be cemented, welded, clamped or cast in the housing.

For fixing the hollow body, in the housing there may be arranged at least one holding element, which has a free end projecting into the interior of the housing and an end connected to the housing, the free end of the at least one holding element lying against a surface of the hollow body.

Good securement of the hollow body, while at the same time compensating for tolerances of the housing or of the hollow body, can be achieved by a spring that acts in the direction of the longitudinal center axis of the light source being arranged between a rear side of the hollow body that is facing away from the annularly encircling body and a rear wall of the housing.

According to a variant of the invention, it may also be provided that a suction cup is arranged between a rear side of the hollow body that is facing away from the annularly encircling body and a rear wall of the housing. Good fixing of the hollow body on the housing can likewise be ensured by the suction cup.

Mounting of the light source in a holder can be facilitated by there being arranged on the outer side of the housing at least one holding element, which has a free end projecting from the housing and an end connected to the housing.

Production and assembly of the light source are easier if the housing is formed by two half-shells connected to one another.

The aforementioned problem is also solved according to the invention with a sighting device of the type mentioned at the beginning by the holder having a housing, the housing of the light source and the housing of the holder being connected to one another in a frictionally engaging and/or interlocking manner.

Good fixing of the light source in the holder can be achieved in an easy way by O-rings being arranged between the housing of the light source and the housing of the holder. The O-rings are preferably produced from an elastomeric material, for example from a rubber-elastic material.

Very good fastening of the light source can be provided by the housing of the holder having a bore with an internal thread, the housing of the light source having an external thread corresponding to the internal thread of the bore and the housing of the holder and the housing of the light source being screwed to one another.

A particularly reliable connection between the light source and the holder can be ensured by the housing of the light source and the housing of the holder being riveted to one another, there being arranged on a rear wall of the housing of the light source that is facing away from the light-emitting end face of the hollow body a shank of a rivet that passes through an opening in the housing of the holder, a head of the rivet being arranged on an outer side of the housing of the holder that is facing away from the housing of the light source and said head supporting itself against the outer side of the housing of the holder.

Easy connecting and releasing of the light source and the holder can be achieved by the housing of the light source and the housing of the holder being connected to one another by way of a bayonet closure. This variant of the invention also makes it possible for the light source of the sighting device to be easily exchanged. Thus, for example, the light source can be quickly exchanged for a light source of a different color if the ambient light conditions so require.

According to a development of the invention which is distinguished by easy mounting and likewise a very reliable connection between the light source and the holder, it may be provided that the housing of the light source has at least one groove on an outer side and the housing of the holder has at least one groove on an inner side, the housing of the light source and the housing of the holder being connected to one another by at least one pin engaging over a certain portion in the groove of the housing of the light source and over a certain portion in the groove of the housing of the holder.

In addition, it may be provided that the housing of the light source has on its outer side holding portions in the form of clearances or extensions and the housing of the holder likewise has on its inner side holding portions in the form of clearances or extensions, the holding portions of the housing of the light source and the holding portions of the housing of the holder engaging in one another.

According to a further advantageous embodiment, it may be provided that the housing of the light source is arranged in a bore of the housing of the holder and is held in the housing of the holder by means of a nut tapering conically in a light-exiting direction.

A variant of the invention which is distinguished by a simple construction provides that the housing of the light source is conically formed and is pressed into a cylindrical bore of the housing of the holder.

A particularly favorable development of the invention consists in that the housing of the light source is held in the housing of the holder by means of at least one ring pressed in between the housing of the light source and the housing of the holder.

In the case of the light sources according to the prior art cited at the beginning, it is also disadvantageous that they are adhesively bonded to a holder, and therefore in a fitted state cannot be easily exchanged. Therefore, a further problem addressed by the invention is that of making it possible for the light source to be easily exchanged.

This problem is solved with a light source of the type mentioned at the beginning by the housing having at least one interface for the connection to a holder for the light source, in particular a nondestructively re-releasable, frictionally engaging and/or interlocking connection.

A great advantage of the invention is consequently the facilitated mounting in the front sight or rear sight. It has so far usually been necessary for the light source to be manually cemented in. In almost all cases this takes place by means of an adhesive bonding process that is laborious and not very popular in the industry. The invention has the great advantage here that the mounting can be made adhesive-free, and consequently can be automated much more easily and made easier.

A variant of the invention which is also particularly suitable for emergency lighting means provides that the housing has on at least one portion of a body surface a clearance through which light emitted by the hollow body exits.

In order to make it possible for the hollow body to be easily exchanged, the hollow body and the housing may each have at least one interface for the connection of the hollow body to the housing, in particular a nondestructively re-releasable, frictionally engaging and/or interlocking connection.

According to an advantageous variant of the invention which is distinguished by easy handling and makes it possible for the hollow body to be quickly mounted and removed again, it may be provided that the at least one interface of the hollow body and the at least one interface of the housing form a magnetic closure.

It is particularly advantageous if the housing of the light source is formed by two half-shells of plastic, which are welded and/or adhesively bonded to one another and/or are connected to one another by means of snap-fitting.

Easy mounting in the holder of the sighting device can be ensured by the housing having ribs on an outer side of at least one half-shell, which are preferably formed in one piece with the half-shell. The ribs may taper in the direction of an end face of the half-shell.

For fixing the hollow body in the housing, it may be provided that each half-shall has inwardly projecting extensions for fixing the hollow body.

Centering of the half-shells during the mounting is facilitated by at least a first of the half-shells having at least one extension and at least a second of the half-shells having at least one clearance corresponding to the at least one extension.

It is very advantageous with regard to welding by means of ultrasound if at least one of the half-shells has on a connecting surface in relation to the other half-shell at least one rib projecting from the connecting surface.

Furthermore, the holder may have at least one interface for the connection to the housing of the light source, in particular a nondestructively re-releasable, frictionally engaging and/or interlocking connection.

Easy exchanging of the light source can be accomplished with an arrangement comprising a light source as claimed in one of claims 32 to 35 and a holder as claimed in claim 36, the holder and the housing of the light source each having at least one interface, the at least one interface of the housing and the at least one interface of the holder being in engagement with one another in a connected state of the light source with the holder, and the light source and the holder being connected to one another in an interlocking and/or frictionally engaging manner, the at least one interface of the housing and the at least one interface of the holder in engagement therewith being releasable from one another.

A very reliable connection of the light source to the holder can be ensured by the at least one interface of the housing and the at least one interface of the holder forming a bayonet closure.

According to an advantageous embodiment of the invention which is distinguished by very easy mounting, the at least one interface of the housing and the at least one interface of the holder may form a snap closure.

According to an advantageous development of the invention, the at least one interface of the housing and the at least one interface of the holder may form a screw closure.

According to a further favorable variant, it may be provided that the at least one interface of the housing and the at least one interface of the holder form a clamping closure.

In addition, the at least one interface of the housing and the at least one interface of the holder may form a magnetic closure.

For better understanding of the invention, it is explained in more detail on the basis of the following figures.

In a greatly simplified, schematic representation in each case:

Figure 1:
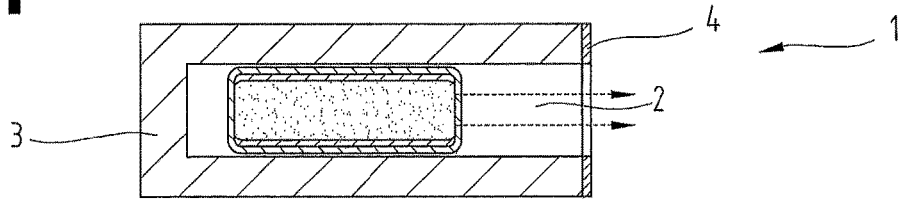
FIG. 1 shows a section through a first variant of a light source according to the invention.

To begin, it should be stated that in the variously described embodiments parts that are the same or correspond to one another are provided with the same reference numerals or the same component designations, it being possible for the disclosures contained in the description as a whole to be transferred analogously to the same parts with the same reference numerals or the same component designations. The positional indications chosen in the description, such as for example, top, bottom, to the side, etc., refer to the figure being directly described and shown, and, when there is a change of position, these positional indications can also be transferred analogously to the new position.

According to FIG. 1, a light source 1 has a hollow body 2 closed in a gas-tight manner, for example a small glass or plastic tube, which is coated on at least one inner side with a phosphor and is filled with gaseous tritium and emits light. The hollow body 2, which may also be referred to as a lighting means, may for example emit light in the visible range or else in the UV or infrared range. The hollow body 2 is arranged in a housing 3 of the light source 1. The outer contour of the housing 3 is preferably formed substantially in the form of a cylindrical body. The light source 1 may have a body 4 of a colored material which annularly encircles a longitudinal center axis of the light source 1. This is advantageous in particular whenever the light source is used in a sighting device. The color of the body 4 is different from black in daylight, in order that the body 4 is set apart from a usually dark-colored, in particular black, rear sight or a dark-colored, in particular black, front sight and good visibility of the ring in daylight is ensured. Thus, the body 4 may for example have a red, green, yellow, blue, orange, violet or white, etc. color.

In addition, the material of the annularly encircling body 4 may have fluorescent and/or phosphorescent molecules. Thus, the material of the annularly encircling body may for example consist of polymethylmethacrylate, embedded in which are molecules that for example fluoresce or are excited to a phosphorescent state when exposed to ambient light. Sulfides of alkaline earth metals (for example zinc sulfide) that are mixed with small amounts of heavy metal salts may be used as phosphorescent materials.

In a plan view of the annularly encircling body 4 and the hollow body 2 along the longitudinal center plane of the light source 1, the end face of the hollow body 2 appears as a central point, which is surrounded by a colored circle. The colored circle is produced by an end face of the annularly encircling body that is facing away from the end face of the hollow body 2. During daytime, the colored circle formed by the body 4 is easily visible, while at night the end face of the hollow body 2 can be easily perceived as a brightly light-emitting point. At twilight, a seamless transition in the visibility between the colored circle and the light-emitting point takes place.

However, it should be pointed out at this stage that the arrangement of the annularly encircling body 4 is not absolutely necessary if the light source 1 is intended for a different purpose, for example as an emergency lighting means. Furthermore, it should be pointed out that all of the statements made in this document with respect to a connection of the housing 3 and the hollow body 2 to one another and to a holder 19, as described further below and represented in FIGS. 34-45, apply both to a light source 1 with and a light source 1 without the colored, annularly encircling body 4.

The housing 3 preferably consists of a plastic, for example a thermoplastic, a metal, a ceramic or mineral material, for example glass. The body 4 preferably likewise consists of plastic, for example a thermoplastic, a metal, a ceramic or mineral material, for example glass, an ink or a paint, etc. It should be mentioned at this stage that the housing 3 and the body 4 may also consist of a mixture of the aforementioned materials.

The housing 3 may have on its inner side a highly reflective coating, in particular a mirroring, in order to increase the intensity of the light emitted in the direction of a viewer. In particular, an end face of the housing 3 that is facing away from the viewer may have a mirroring on an inner side. Alternatively or in addition, however, the hollow body 2 may also have on its outer side a highly reflective coating, in particular a mirroring, facing the interior of the hollow body 2. The coating may for example be provided by vapor depositing, spraying, dip coating, spreading or electroplating a metal layer or by adhesively attaching a highly polished metal foil or sheet (for example of silver, gold or aluminum or any other suitable metal). However, the coating does not have to be of a metallic material, and so for example white acrylic paint has been found to be particularly suitable for producing the coating. The reflectivity of the highly reflective coating is particularly preferably between 0.7 and 1.

The annularly encircling body 4 is arranged on a terminal end region of the housing 3 or between the terminal end region of the housing 3 and a light-emitting end face of the hollow body 2. In the embodiment of the invention that is represented here, the body 4 is printed on an end face of the housing 3. The body 4 may be produced by applying a circle of a colored ink or a colored paint.

As an alternative to this, the annularly encircling body 4 may however also be printed on the light-emitting end face of the hollow body 2. The body 4 may for example be printed on by means of an inkjet printing process. Alternatively, however, other printing processes may also be used. It is also possible to apply the body 4 manually in the form of a circle.

The hollow body 2 and the housing 3 may each have at least one interface for the nondestructively re-releasable, frictionally engaging and/or interlocking connection of the hollow body 2 to the housing 3. The interface of the hollow body 2 and the interface of the housing 3 may for example form a magnetic closure. Thus, for example, a metal strip or a magnetizable coating may be provided on the outer side of the hollow body 2, while a magnet may be fastened to the housing 3, or vice versa.

According to a variant of the invention that is also particularly suitable for emergency lighting means, provides that the housing 3 has on at least a portion of a body surface a clearance through which light emitted by the hollow body exits.

Figure 2:
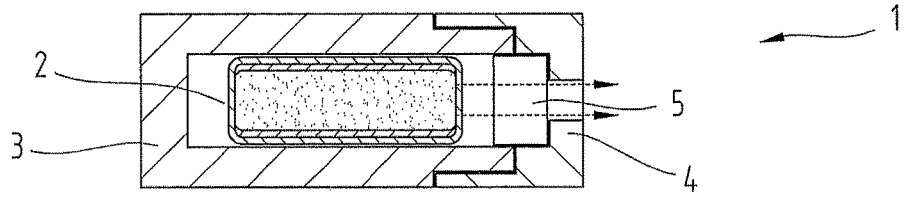
FIG. 2 shows a section through a second variant of a light source according to the invention.

According to FIG. 2, the light source 1 may have a protective covering 5 of a transparent material, by which the light-emitting end face of the hollow body 2 is covered. The protective covering 5 may be partially or entirely arranged in the housing 3.

It should be quite generally pointed out at this stage that many of the light sources 1 described below may also have two protective coverings 5 and be formed symmetrically, each terminal end of the light source 1 then being able to emit light and be formed identically or similarly. Thus, in particular, the embodiments represented in FIGS. 1-22 and 24-28 and 30-33 may be formed symmetrically and each have two light-emitting end faces, which are in each case provided with a protective covering 5 (not represented in FIGS. 21 and 22 and in FIGS. 24-28 and 30). This duality of the light source 1 allows the creation of a double front sight and a double rear sight, which can be turned by 180° by a simple turning mechanism. The two orientations make it possible for example for the heights to be adjusted to slightly different levels.

The annularly encircling body 4 may cover a peripheral region of the light-emitting end face of the hollow body 2. A central region of the light-emitting end face of the hollow body 2 is visible through a clear cross section of the annularly encircling body 4. In the embodiment represented, the body 4 has a holding lug, which reaches around the protective covering 5 on a side facing away from the hollow body 2 and lies against said side. To be more precise, a peripheral region of the surface of the protective covering 5 that is facing away from the hollow body 2 may lie against the annularly encircling body 4 (with and without play) and be covered by it. In the variant represented, the holding lug goes over into a stepped portion. The housing 3 and the stepped portion may be formed in line with one another, so that a planar and stepless outer surface of the light source 1 is obtained.

Figure 3:
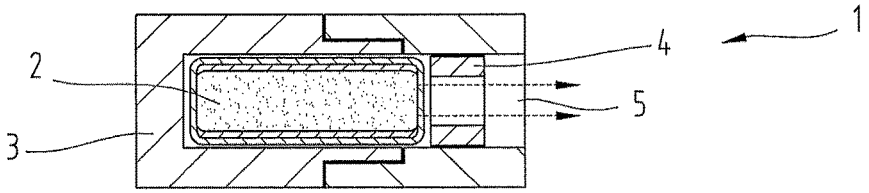
FIG. 3 shows a section through a third variant of a light source according to the invention.

As represented in FIG. 3, the body 4 may also be formed by an application of color, for example by applying luminescent or phosphorescent color or by applying a conventional ink, as used in inkjet printing, or by applying a paint, etc., to the protective covering 5. The body 4 may be printed on the protective covering 5, for example by means of an inkjet printer or some other printer. Alternatively, the application of color may also be performed by hand. According to the embodiment represented, the housing 3 may have a front part and a rear part, with reference to the light-exiting side of the light source. The protective covering 5 may be arranged in one of the parts, while the hollow body 2 may be arranged in the other part. The parts of the housing 3 may be formed congruently in relation to one another at the end regions facing one another and be adhesively bonded and/or welded to one another.

In the embodiment represented in FIG. 3, however, a ring of a colored material may also be arranged instead of the protective covering 5, arranged between the hollow body 2 and a light-exiting side of the light source 1. Here, the ring may be formed from plastic. It has been found to be particularly advantageous if the ring is produced from an elastomeric material, in particular a rubber-elastic material, for example rubber. In the case of this embodiment, the ring may be adhesively attached in the housing 3. In addition, the protective covering 5 may be arranged, the ring preferably being arranged between the protective covering 5 and the hollow body 2.

Figure 4:
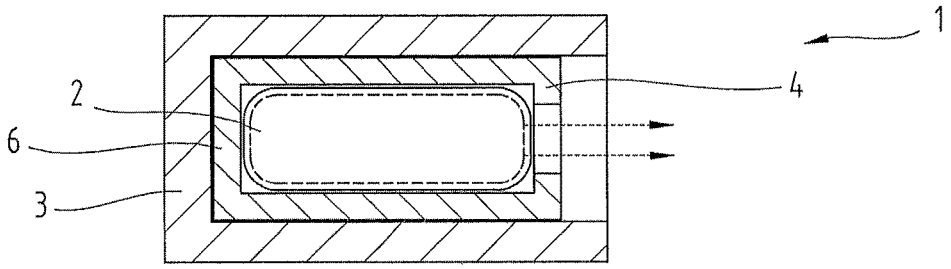
FIG. 4 shows a section through a fourth variant of a light source according to the invention.

As represented in FIG. 4, the annularly encircling body 4 may be part of a holding cage 6, in which the hollow body 2 is arranged. In this embodiment, the body 4 is formed by a holding lug of the holding cage 6 that covers a peripheral region of the end face of the hollow body 2. The holding cage 6 may be connected to an inner side of the housing 3, for example by adhesive bonding and/or by a frictional engagement.

Figure 5:
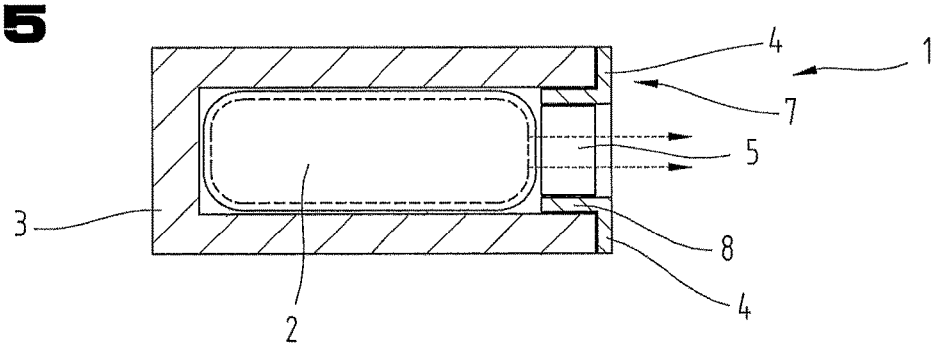
FIG. 5 shows a section through a fifth variant of a light source according to the invention.

As in the case of the embodiment represented in FIG. 4, also in the case of the variant represented in FIG. 5 the annularly encircling body 4 is part of a holder, which in FIG. 5 is identified by the reference numeral 7, by which the protective covering 5 is held in the housing 3. Here, the annularly encircling body 4 may be connected to or formed in one piece with a portion 6 projecting perpendicularly from it. The protective covering 5 may have side surfaces in the form of a cylindrical body, which may be connected to the portion 8 projecting perpendicularly from the annular body 3, for example by adhesive bonding and/or in a frictionally engaging manner.

Figure 6:
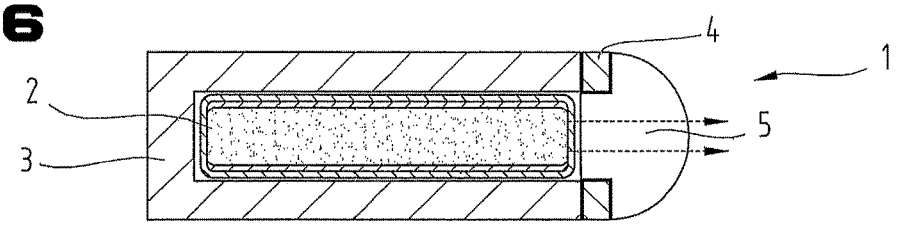
FIG. 6 shows a section through a sixth variant of a light source according to the invention.

According to FIG. 6, the annular body 4 may also be arranged between the protective covering 5 and the housing 3 of the light source 1. In the embodiment represented, the protective covering 5 may have a curved surface and be formed as a lens. Even if the protective covering 5 in the variant represented is represented as a converging lens, according to another variant of the invention it could also be configured as a diverging lens.

Figure 7:
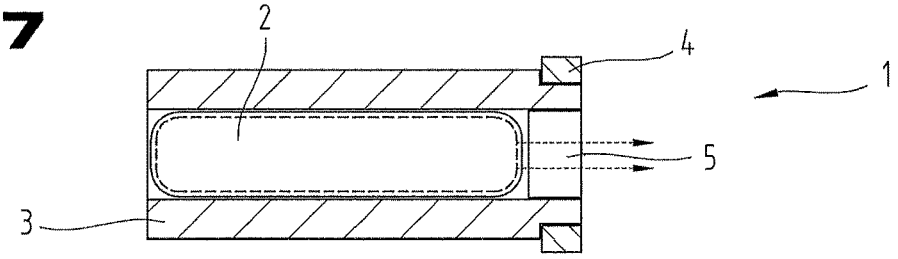
FIG. 7 shows a section through a seventh variant of a light source according to the invention.

FIG. 7 shows an embodiment in which the annularly encircling body 4 is arranged on an outer side of the housing 3 and is attached there by means of a press fit. The annular body 4 may for example be formed from metal or plastic, the protective covering 5 being clamped in the housing 3 by means of the annular body 4. The protective covering 5 and the housing 3 are consequently fixed by a press fit of the annularly encircling body 4.

Figure 8:
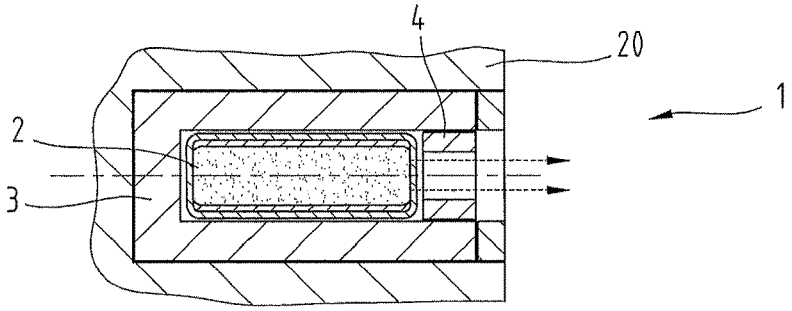
FIG. 8 shows a section through an eighth variant of a light source according to the invention.

As represented in FIG. 8, the body 4 may also be formed by a colored mounting ring, by which the light source 1 is held in a holder. The mounting ring may for example have an external thread, which is formed in a way corresponding to an internal thread of the holder for the light source 1. By screwing in the mounting ring, the light source 1 can be fixed in the holder, the mounting ring lying against an end face of the housing 3. In FIG. 8, a holder 20 for the housing 3 is also schematically depicted.

Figure 9:
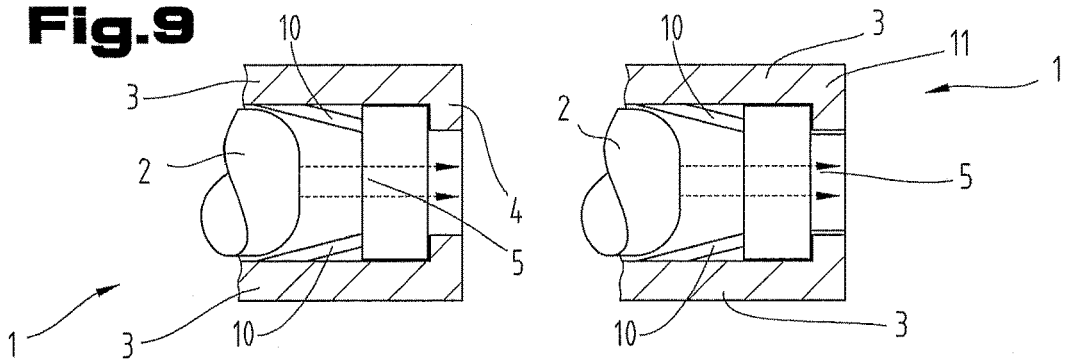
FIG. 9 shows a section through two partial views of a ninth variant of a light source according to the invention.

According to FIG. 9, in the housing 3 there may be arranged one or more holding elements 10, which each have a free end projecting into the interior of the housing 3 and an end connected to the housing 3. The holding elements 10 may form individual portions that are independent of one another and are formed particularly preferably as resilient tongues.

The free ends of the holding elements 10 may lie against a surface of the protective covering 5 that is facing the hollow body 2. The surface of the protective covering 5 that is facing away from the holding elements 10 may be held here in the housing 3 by the annular body 4, which is arranged on the end face of the housing and forms a holding lug. As represented, the body 4 may go over into the housing 3. The housing 3 consequently has in a region of the terminating end region a peripheral region 11 projecting in the direction of the longitudinal center line. This embodiment makes it possible during the mounting to push in the protective covering 5 in the direction of the body 4, after reaching the end position the protective covering 5 being held in this position between the holding elements 10 and the body 4 by a snapping over of the flexible holding elements 10.

Figure 10:
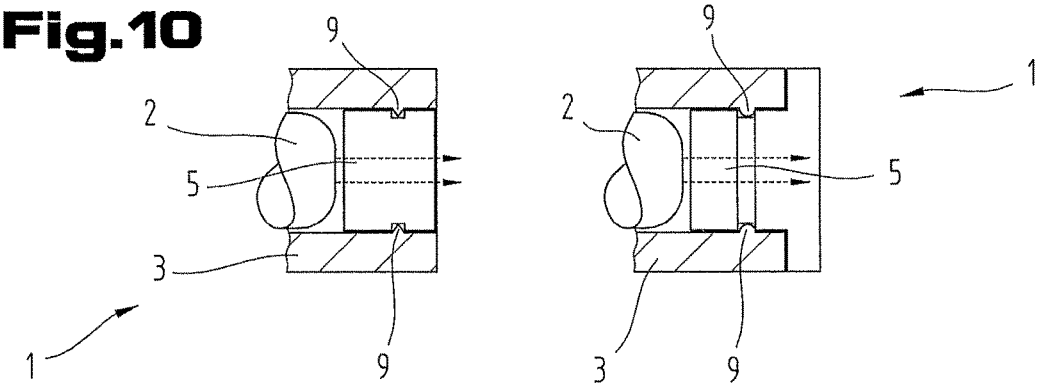
FIG. 10 shows a section through two partial views of a tenth variant of a light source according to the invention.

As shown in FIG. 10, the protective covering 5 may have on its lateral peripheries holding portions in the form of clearances and the housing 3 may likewise have on its inner side holding portions in the form of extensions 9. In a mounted state, the holding portions of the protective covering 5 and the holding portions of the housing 3 engage in one another. As an alternative to the embodiment represented, the protective covering 5 may have extensions and the housing 3 may have corresponding clearances.

Figure 11:
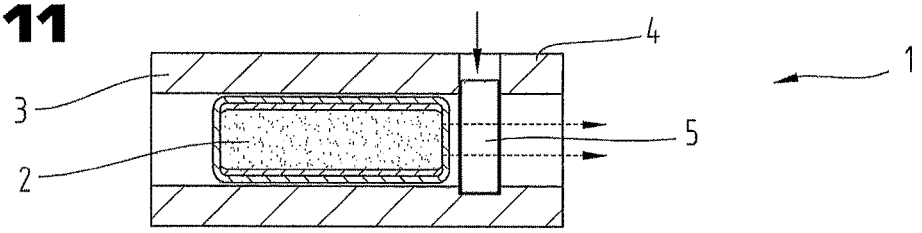
FIG. 11 shows a section through an eleventh variant of a light source according to the invention.

As shown in FIG. 11, the protective covering 5 may be pushed into the housing 3 through an opening in a body surface of the housing 3. After inserting the protective covering 5, the housing 3 may be closed by closing with a part corresponding to a cross section of the opening. Alternatively or in addition to fitting the part just mentioned into the housing 3, the protective covering 5 may be fixed in the housing 3 by adhesive bonding.

Figure 12:
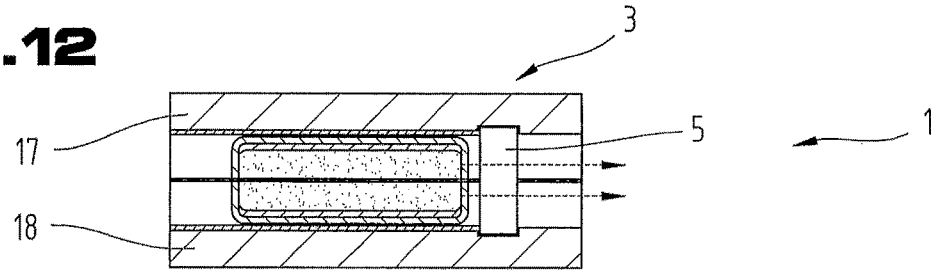
FIG. 12 shows a section through a twelfth variant of a light source according to the invention.

According to FIG. 12, the housing 3 may have at least one encircling clearance, which receives a lateral body surface of the protective covering 5. The clearance in the housing 3 may be formed as an annular encircling groove. In the case of this embodiment, it has been found to be particularly advantageous if the housing 3 is formed by two half-shells 17, 18 connected to one another. This makes it possible inter alia for the housing 3 and the protective covering 5 to be easily connected in an interlocking manner. The two half-shells 17, 18 may be adhesively bonded and/or welded to one another or connected by means of a snap closure.

Figure 13:
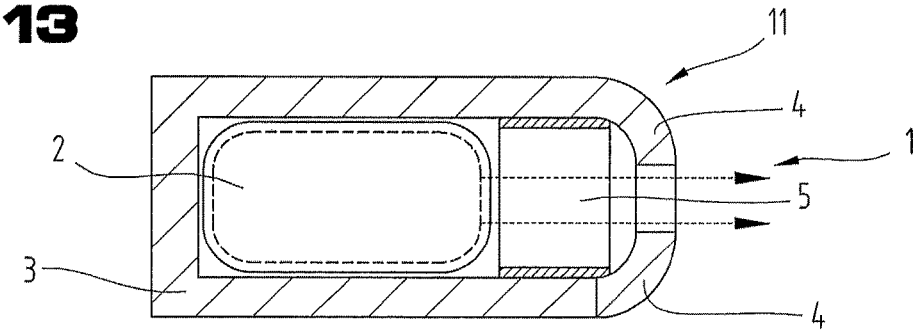
FIG. 13 shows a section through a thirteenth variant of a light source according to the invention.

According to the embodiment represented in FIG. 13, the housing 3 may be bent over at its front periphery 11. The bent part, shown in FIG. 12, may however also be connected to the housing 3 by crimping. The body 4 may be formed by the part that is bent over or connected to the housing 3 by crimping.

Figure 14:
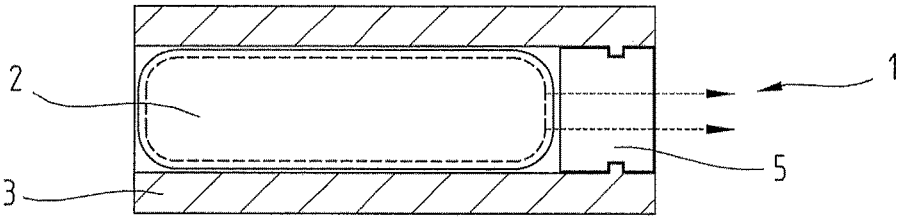
FIG. 14 shows a section through a fourteenth variant of a light source according to the invention.

According to the embodiment represented in FIG. 14, the protective covering 5 may also be connected to the housing 3 by interlocking, which may be formed by an injection-molded part. Thus, the housing 3 may be produced by overmolding the protective covering 5. The protective covering 5 and the housing 3 may also be produced in a multi-component injection-molding process, for example a 2-component injection-molding process.

Figure 15:
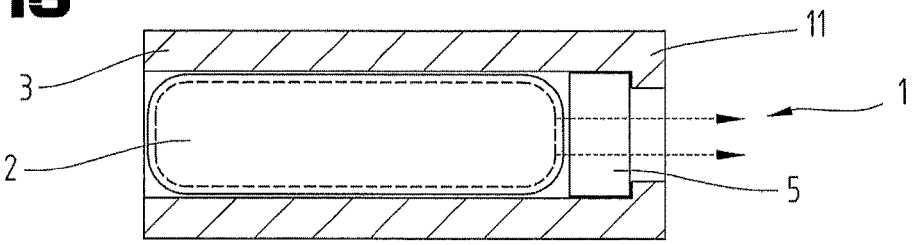
FIG. 15 shows a section through a fifteenth variant of a light source according to the invention.

According to the variant shown in FIG. 15, the protective covering 5 may be inserted from an end facing away from the light-exiting side of the light source 1 until it lies against the periphery 11 of the housing 3. The body 4, which goes over into the housing and in the variant represented is formed by the inwardly projecting periphery 11 of the housing 3, represents here a holding lug for the protective covering 5.

Figure 16:
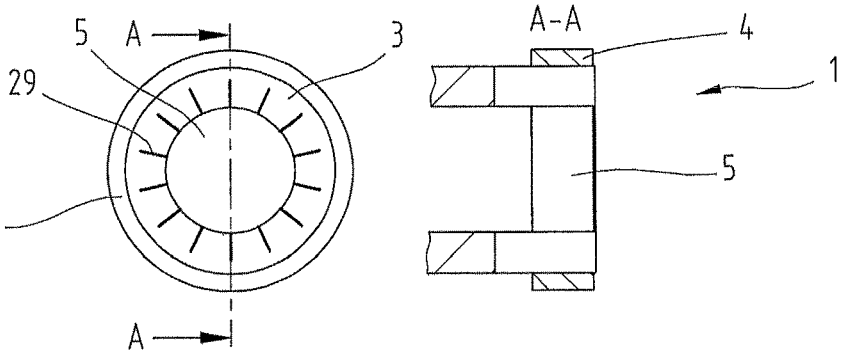
FIG. 16 shows a section through a sixteenth variant of a light source according to the invention.

As represented in FIG. 16, the protective covering 5 may also be held in the housing 3 in a frictionally engaging manner by a collet 29. The annular body 4 may be arranged around the collet 29. The collet may be formed here as a slit sleeve or sleeve part, which is pressed together and held by the body 4.

Figure 17:
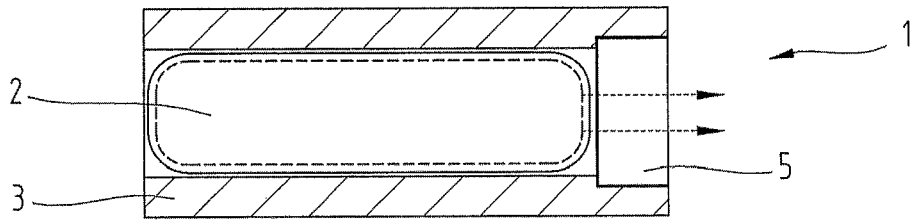
FIG. 17 shows a section through a seventeenth variant of a light source according to the invention.

As shown in FIG. 17, the protective covering 5 may also be connected to the housing 3 by adhesive bonding or welding, for example by ultrasonic welding. The protective covering 5 may however also be pressed into the housing 3. The pressing in may first be performed in a cold state (at a first, lower temperature), with heating of the housing 3 and of the protective covering to a second temperature, higher than the first temperature, being performed in a second step.

In this case, the protective covering 5 advantageously has a higher coefficient of thermal expansion than the housing 3, whereby the protective covering 5 can brace itself in the housing 3.

Figure 18:
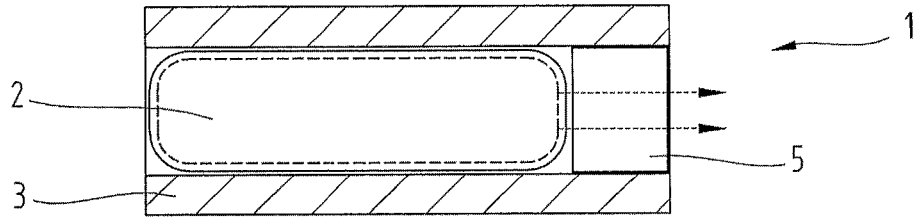
FIG. 18 shows a section through an eighteenth variant of a light source according to the invention.

According to FIG. 18, the protective covering 5 may also be formed by a silicone compound, which is fed into the housing 3 (for example injected).

Figure 19:
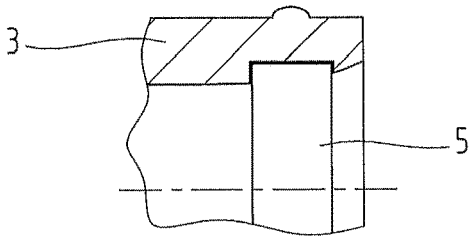
FIG. 19 shows a section through a nineteenth variant of a light source according to the invention.

As represented in FIG. 19, the housing 3 may be formed from an elastic material that makes pressing apart possible in an end region. In the case of this embodiment, the housing 3 has in the end region an annularly encircling groove, into which the protective covering 5 can be pressed. During the insertion of the protective covering 5, a (slight) expansion of the housing 3 may occur. As soon as the protective covering is engaged in the groove of the housing 3, the housing 3 may contract again, whereby the protective covering 5 is held captively in the groove.

Figure 20:
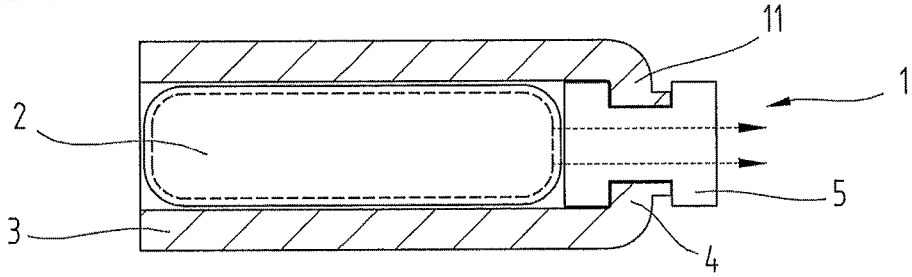
FIG. 20 shows a section through a twentieth variant of a light source according to the invention.

In addition, as represented in FIG. 20, the protective covering 5 may have an H-shaped cross section and be connected to the housing 3 by bending over of end regions of the latter. The housing 3 and the protective covering 5 may for example be connected to one another by crimping.

Figure 21:
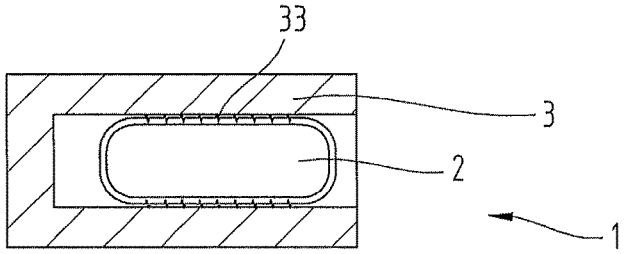
FIG. 21 shows a section through a twenty-first variant of a light source according to the invention.

As shown in FIG. 21, the hollow body 2 may be held in the housing 3 in a frictionally engaging manner, for example cemented, welded, clamped or cast. The hollow body 2 may also be connected to the housing 3 and held in it by way of an interface 33, which may for example be provided by means of one or more magnets.

Figure 22:
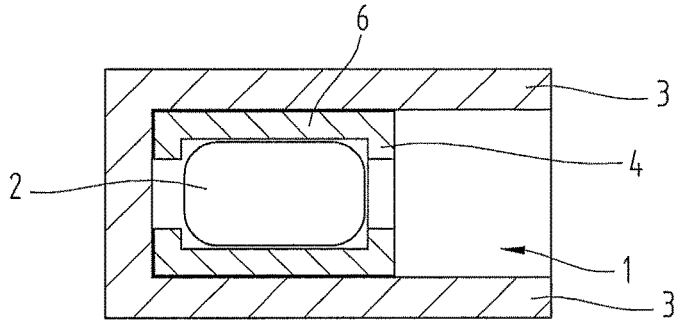
FIG. 22 shows a section through a twenty-second variant of a light source according to the invention.

The holding cage 6 represented in FIG. 22, in which the hollow body 2 is arranged, may be pressed into the housing 3 and/or adhesively bonded and/or welded to it. The hollow body 2 may be clamped, welded, adhesively bonded or loosely arranged in the holding cage 6.

Figure 23:
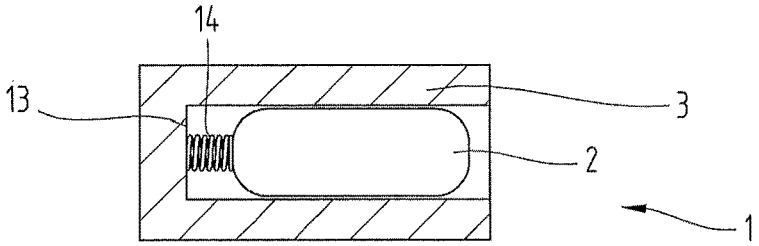
FIG. 23 shows a section through a twenty-third variant of a light source according to the invention.

As represented in FIG. 23, a spring 14 that acts in the direction of the longitudinal center axis of the light source 1 and positions the light source 1 against a stop may be arranged between a rear side of the hollow body 2 that is facing away from the annularly encircling body 4 and a rear wall 13 of the housing 3. In addition to the spring 14, O-rings may for example be arranged around the hollow body 2, in order to prevent sliding out from the housing 3.

Figure 24:
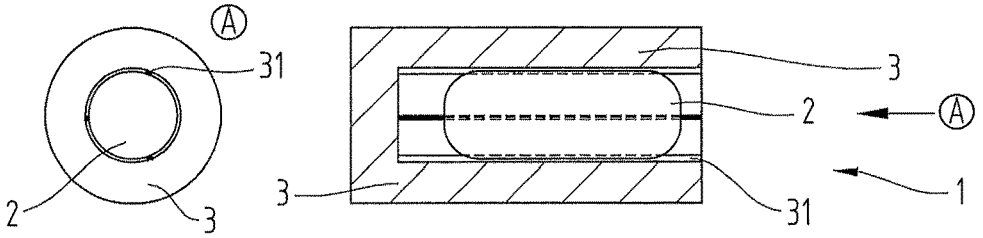
FIG. 24 shows two representations of a twenty-fourth variant of a light source according to the invention, the right-hand representation showing a section along a longitudinal axis of the light source and the left-hand representation showing a view from direction A in the right-hand representation.

According to FIG. 24, the hollow body 2 may however also be only pressed into the housing 3 and held therein by a frictional engagement.

Figure 25:
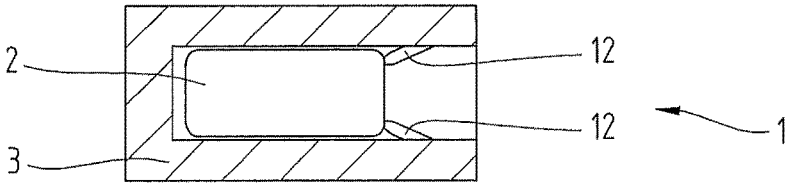
FIG. 25 shows a section through a twenty-fifth variant of a light source according to the invention.

In the case of the embodiment as shown in FIG. 25, in the housing 3 there may be arranged one or more holding elements 12, which each have a free end projecting into the interior of the housing 3 and an end connected to the housing. The free ends of the holding elements 12 may lie (directly) against a surface of the hollow body 2. The hollow body 2 is pressed against the rear wall 13 of the housing 3 and secured against falling out by the holding elements 12. For mounting, the hollow body 2 may be inserted into the housing 3 from the front, the holding elements 12, which may be resiliently formed, being moved against an inner wall of the housing 3 and, after the hollow body 2 has passed, the holding elements 12 springing back or snapping again into a starting position.

Figure 26:
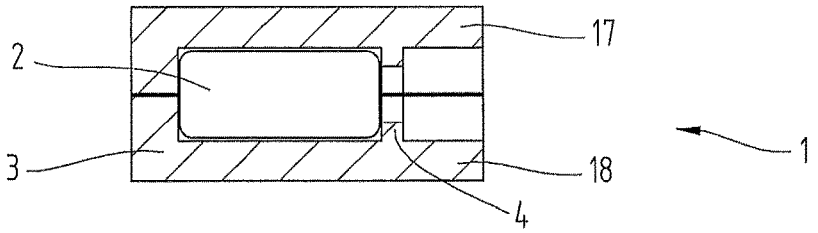
FIG. 26 shows a section through a twenty-sixth variant of a light source according to the invention.

FIG. 26 shows an embodiment according to which the housing 3 may likewise have two half-shells 17, 18 connected to one another and has one or more extensions projecting into the housing interior, which fix the hollow body 2 in housing 3 against the rear wall 13.

Figure 27:
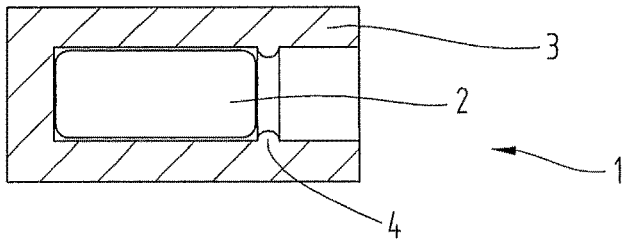
FIG. 27 shows a section through a twenty-seventh variant of a light source according to the invention.

Represented in FIG. 27 is a variant in which the material on an inner side of the housing 3 is made to bulge after insertion of the hollow body 2. This may take place for example by melting and pushing together the material on the inner side of the housing 3. A push rod or an element with a plate-shaped head of which the cross-sectional area is slightly larger than the clear cross section of the housing 3 before the pushing together of the material may be used for example for the pushing together of the material. According to a preferred embodiment, the protective covering 5 may also be used as the plate-shaped element for pushing together the material on the inner side of the housing 3.

The bead 32 represented in FIG. 27 may also already be present before the insertion of the hollow body 2 into the housing 3. The hollow body 2 may be pushed over this bead 32 and finally held in the housing 3 by an interlocking. It is particularly favorable here if the housing 3 is produced from plastic.

Figure 28:
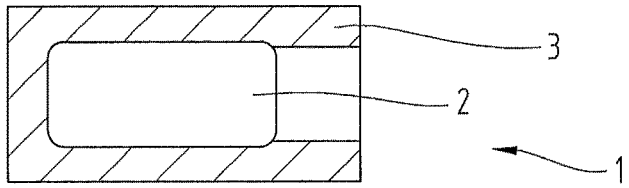
FIG. 28 shows a section through a twenty-eighth variant of a light source according to the invention.

According to the variant shown in FIG. 28, the housing 3 may be produced by overmolding of the hollow body 2.

Figure 29:
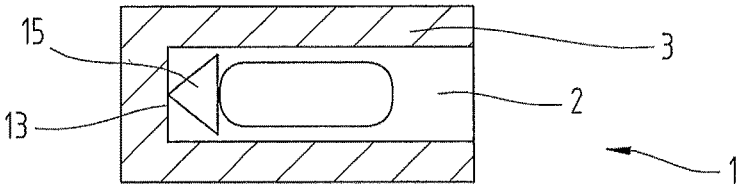
FIG. 29 shows a section through a twenty-ninth variant of a light source according to the invention.

FIG. 29 represents a variant in which a suction cup is arranged between the hollow body 2 and the rear wall 13 of the housing 3. The suction cup 15 allows the hollow body 2 to be held in its position within the housing 3.

Figure 30:
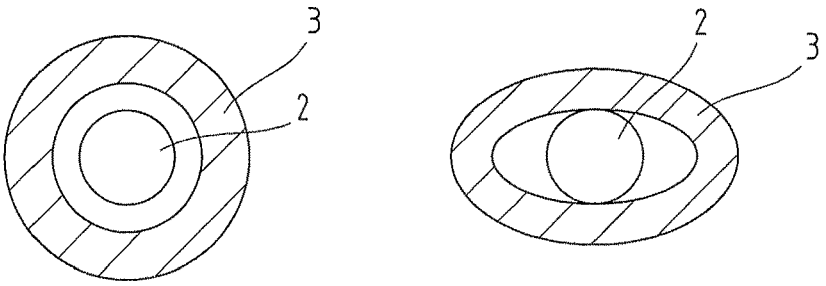
FIG. 30 shows a section through two partial views of a thirtieth variant of a light source according to the invention.

According to FIG. 30, the hollow body 2 may be fixed in the housing 3 by deforming (squeezing) of the housing 3. Here, the left-hand illustration shows the housing 3 in an unsqueezed state, while the right-hand illustration represents the housing in a squeezed state.

Figure 31:
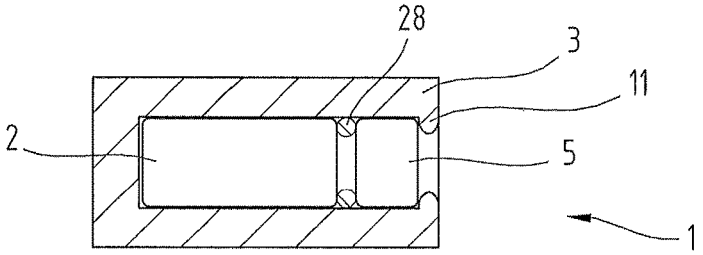
FIG. 31 shows a section through a thirty-first variant of a light source according to the invention.

In the case of the variant shown in FIG. 31, the hollow body 2 may be held in the housing 3 by a rubber component, for example an O-ring 28. The O-ring may be adhesively bonded and/or welded to the housing 3 in order to ensure good fixing.

Figure 32:
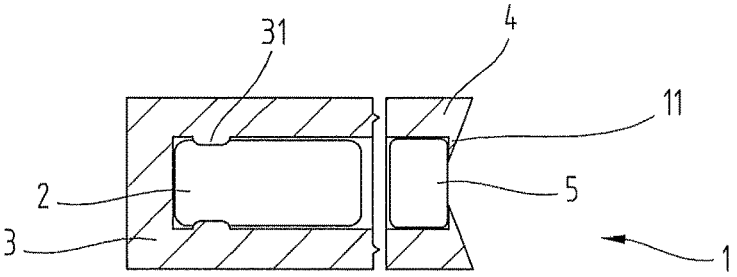
FIG. 32 shows a section through a thirty-second variant of a light source according to the invention.

According to FIG. 32, one or more squeezing ribs 31, which clamp the hollow body 2 and hold it in the housing 3, may project from the inner side of the housing 3. On the front side of the housing 3 there may be arranged the annular body 4, which has a holding lug 11 for the protective covering 5. The body 4 may for example be adhesively bonded or welded to the end face of the housing 3, for example by means of an ultrasonic welding process.

Figure 33:
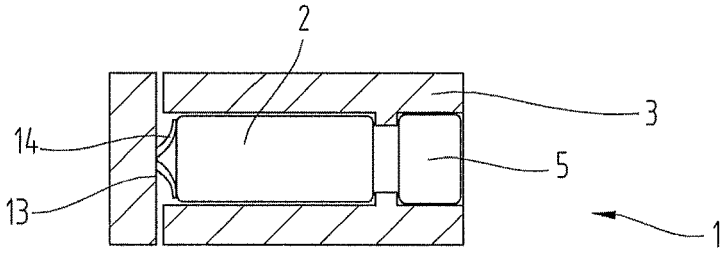
FIG. 33 shows a section through a thirty-third variant of a light source according to the invention.

According to FIG. 33, for inserting the hollow body 2, the rear wall 13 may only be arranged on the housing 3 subsequently. For mounting, the hollow body 2 may be pushed in as far as the extensions projecting into the interior of the housing 3, which form a stop for the hollow body 2. Then the spring 13 is inserted and the rear wall 13 is connected to the housing 3. The hollow body 2 is fixed against the inwardly projecting extensions of the housing 3 and held in its position by the spring 13.

Figure 34:
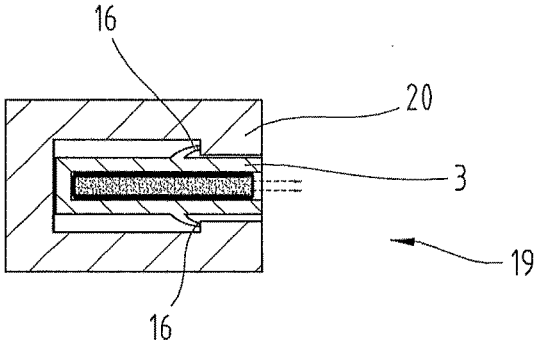
FIG. 34 shows a section through a first variant of a holder of an arrangement according to the invention comprising a holder and a light source according to the invention.

As represented in FIG. 34, on the outer side of the housing 3 there may be arranged holding elements 16, which each have a free end projecting from the housing 3 and an end connected to the housing 3. Here, the holding elements 16 form an interface on the housing 3 for the fastening to a holder 16.

With their free ends, the holding elements 16 may support themselves against corresponding surface areas of a holder 19, for example of a sighting device or an emergency lighting means, etc. The holder 19 serves for receiving the light source 1 and for its fixing in a sighting device, emergency lighting means, etc. The holder 19 and the light source 1 form an arrangement in the sense of the invention.

When the light source 1 is being pushed into the housing 20 of the holder 19, the holding elements 16 are moved against the outer side of the housing 3. After reaching the end position, the holding elements spring into a starting position and prevent the light source 1 from falling out of the housing 20 of the holder 19.

Generally, however, it can be said about the connection of the light source 1 and the holder 19 that the housing 3 of the light source 1 and the housing 20 of the holder 19 are connected to one another in a frictionally engaging and/or interlocking manner in order to fix the light source 1 in the holder 19. It should be pointed out at this stage that both the light source 1 and the holder 19 may have interfaces for a connection, in particular a re-releasable connection, to one another. In a connected state, an interface of the housing 3 and an interface of the holder 19 are in engagement with one another and connect the light source 1 and the holder 19 to one another in an interlocking and/or frictionally engaging manner.

Figure 35:
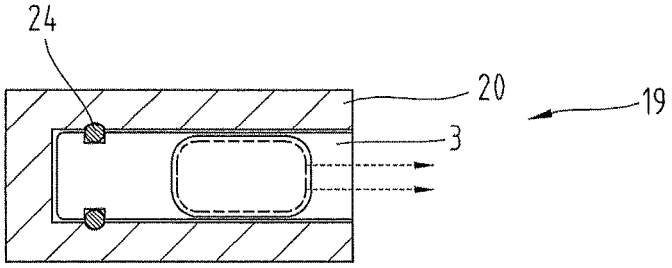
FIG. 35 shows a section through a second variant of a holder of an arrangement according to the invention comprising a holder and a light source according to the invention.

As shown in FIG. 35, the housing 3 of the light source 1 may have at least one groove on an outer side and the housing 20 of the holder 19 may have at least one groove on an inner side. The housing 3 of the light source 1 and the housing 20 of the holder 19 may be connected to one another by at least one pin 24 engaging over a certain portion in the groove of the housing 3 of the light source 1 and over a certain portion in the groove of the housing 20 of the holder 19.

Figure 36:
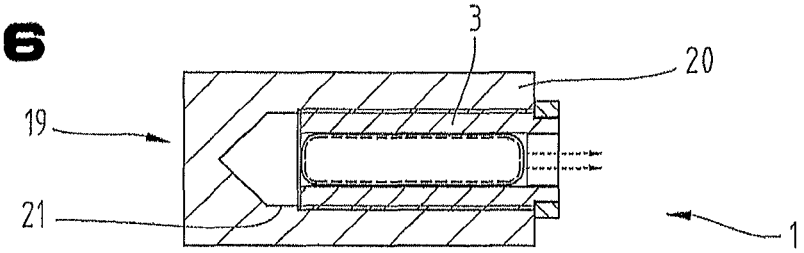
FIG. 36 shows a section through a third variant of a holder of an arrangement according to the invention comprising a holder and a light source according to the invention.

According to the variant represented in FIG. 36, the housing 20 of the holder 19 may have a bore 21 with an internal thread. The housing 3 of the light source 1 may have an external thread corresponding to the internal thread of the bore, it being possible for the housing 20 and the light source 3 to be screwed to one another. The housing 3 of the light source 1 and the housing 20 of the holder 19 may also be connected to one another by way of a bayonet closure.

Figure 37:
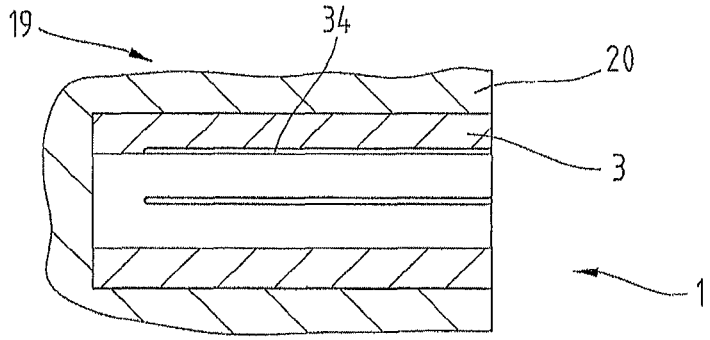
FIG. 37 shows a section through a fourth variant of a holder of an arrangement according to the invention comprising a holder and a light source according to the invention.

According to FIG. 37, the light source 1 may also be pressed into or cemented in the housing 20 of the holder 19. In order to ensure good venting of the interior of the housing 20 during mounting and avoid the creation of an air cushion between the housing 20 and the housing 3, at least one groove 34 or a venting hole that is open to a surrounding area of the light source 1 and of the holder 19 may be provided on an inner wall of the housing 20 or on an outer wall of the housing 3.

Figure 38:
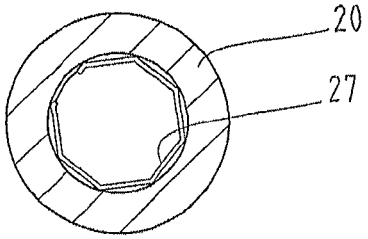
FIG. 38 shows a fifth variant of a holder of an arrangement according to the invention comprising a holder and a light source according to the invention.

As represented in FIG. 38, the housing 3 of the light source 1 may also be secured against slipping in the housing 20 of the holder 19 by means of a spring 27 or a securing ring arranged between the housing 3 and the housing 20. For receiving the spring 27 or the securing ring, encircling grooves may be arranged on the outer side of the housing 3 and on the inner side of the housing 20. By engaging of the spring 27 or the securing ring in these grooves, the two housings 3 and can be secured against axial slipping in relation to one another. Particularly preferably, the spring 27 or the securing ring is produced from nitinol.

Figure 39:
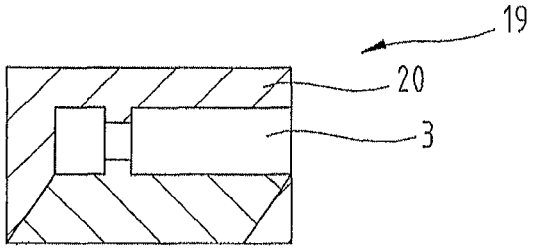
FIG. 39 shows a section through a sixth variant of a holder of an arrangement according to the invention comprising a holder and a light source according to the invention.

In the case of the embodiment shown in FIG. 39, the housing 3 of the light source 1 may have on its outer side holding portions in the form of clearances or extensions and the housing 20 of the holder 19 may likewise have on its inner side holding portions in the form of clearances or extensions, the holding portions of the housing 3 of the light source 1 and the holding portions of the housing 20 of the holder 19 engaging in one another. For mounting, the housing 3 may be pushed into the housing 20 through an insertion opening obliquely or transversely in relation to a longitudinal center axis of the housing 20 and the opening closed thereafter, so that the housing 3 is connected to the housing 20 in an interlocking manner. Preferably the same material of which the remaining part of the housing 20 consists is used for closing the insertion opening of the housing 20.

Figure 40:
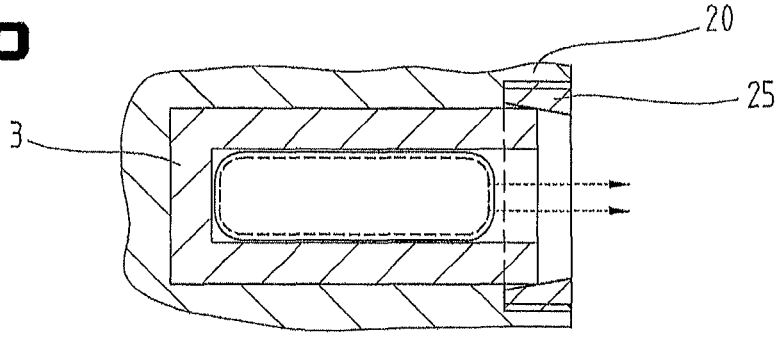
FIG. 40 shows a section through a seventh variant of a holder of an arrangement according to the invention comprising a holder and a light source according to the invention.

As shown in FIG. 40, the housing 3 of the light source 1 may be arranged in a bore of the housing 20 of the holder 19 and be held in the housing 20 of the holder 19 by means of a nut 25 tapering conically in a light-exiting direction. The nut 25 may have on an outer body surface an external thread, which interacts with a corresponding internal thread of the bore in order to make screwing of the nut 25 with the bore possible. The nut 25 may however also be adhesively bonded and/or welded or welded to the bore.

Figure 41:
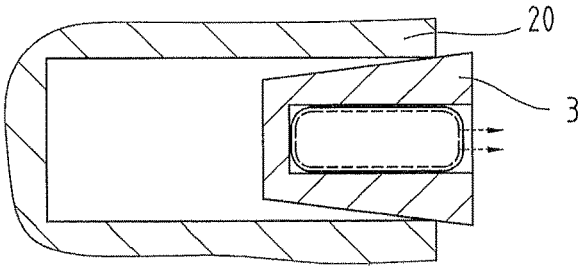
FIG. 41 shows a section through an eighth variant of a holder of an arrangement according to the invention comprising a holder and a light source according to the invention.

The housing 3 of the light source 1 may also be conically formed, as is represented in FIG. 41, and be pressed into a cylindrical bore of the housing 20 of the holder 19. In the case of this embodiment, it is of advantage if the housing 3 is produced from an elastomeric material that has a lower Shore D hardness than the material of the housing 20. Thus, the material of the housing 3 may have a Shore D hardness of 30 to 70, while the material of the housing 20 may have a Shore D hardness of 70-100.

Figure 42:
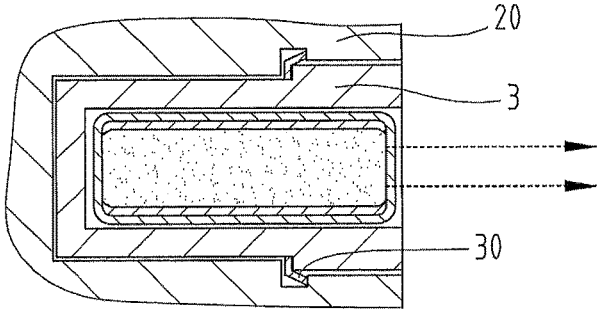
FIG. 42 shows a section through a ninth variant of a holder of an arrangement according to the invention comprising a holder and a light source according to the invention.

In the case of the embodiment represented in FIG. 42, the housing 3 is secured against becoming axially detached from the housing 20 by a snap ring 30. During mounting, a resilient portion of the snap ring 30 is moved against the surface of the housing 3 and in the end position of the housing 3 springs back again into its starting position. In a mounted state, a first periphery of the snap ring lies against a surface area of the housing 20, while a second periphery supports itself on the housing 3 and a body surface of the snap ring in a region adjoining the second periphery is arranged oriented between surface areas of the housings 3 and 20 running parallel to one another and surfaces parallel to them. The snap ring 30 has a kink between the two peripheries, the supporting surfaces of the housings 3 and 30 against which the peripheries of the snap ring 30 lie running substantially normal to one another.

Figure 43:
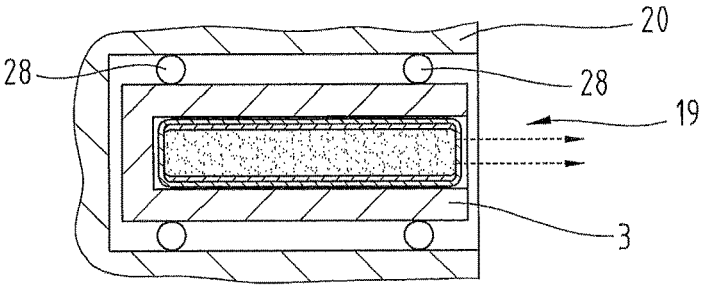
FIG. 43 shows a section through a tenth variant of a holder of an arrangement according to the invention comprising a holder and a with light source according to the invention.

According to the embodiment represented in FIG. 43, O-rings 28 may be arranged between the housing 3 of the light source 1 and the housing 20 of the holder 19 in order to establish a frictionally engaging connection between the housing 3 and the housing 20.

Figure 44:
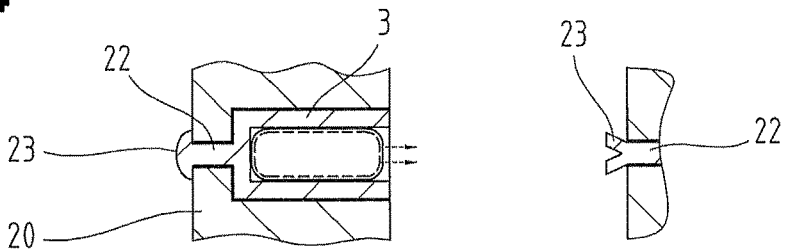
FIG. 44 shows a section through an eleventh variant of a holder of an arrangement according to the invention comprising a holder and a light source according to the invention.

As shown in FIG. 44, the housing 3 of the light source 1 and the housing 20 of the holder 19 may be riveted to one another. On a rear wall of the housing 3 of the light source 1 that is facing away from the light-emitting end face of the hollow body 2 there may be arranged a shank 22 of a rivet that passes through an opening in the housing 20 of the holder 19. On an outer side of the housing 20 that is facing away from the housing 3 of the light source 1 there is arranged a head 23 of the rivet, which supports itself against the outer side of the housing 20 of the holder 19. For mounting, the not yet bent-over head 23 and parts of the shank 22 of the rivet may be pushed through the opening in the housing 20. Then the two housings 20 and 3 may be captively connected to one another by bending over of the head 23.

Figure 45:
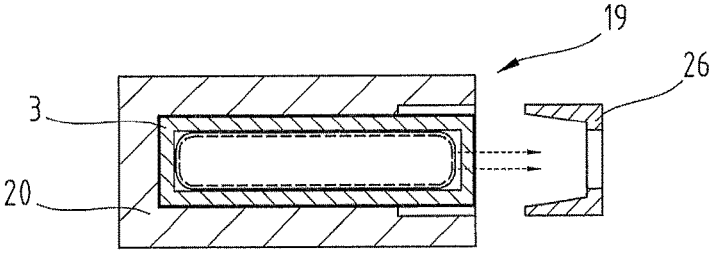
FIG. 45 shows a section through a twelfth variant of a holder of an arrangement according to the invention comprising a holder and a light source according to the invention.

According to FIG. 45, the housing 3 of the light source 1 may be held in the housing 20 of the holder 19 by means of at least one colored ring 26, which is pressed in between the housing 3 of the light source 1 and the housing 20 of the holder 19 and by which the body 4 is formed.

Alternatively or in addition to the aforementioned embodiments, the interfaces of the housing 3 and of the holder 19 may also form a magnetic closure. Here, a metal strip or a magnetizable coating may for example be arranged on the housing 3 or the housing may be produced from a magnetizable material (metal), while a magnet may be arranged on the holder. Of course, the positions of the magnet(s) and the magnetizable material may also be changed over. Alternatively or in addition, magnets of opposite polarity may also be arranged on the housing 3 and the holder 19.

The arrangement represented in the figures, comprising the light source 1 and the holder 19, may be used both as a sighting device, for example as a front sight, or else quite generally as a holder for the light source, for example in the form of an emergency lighting means.

Figure 46:
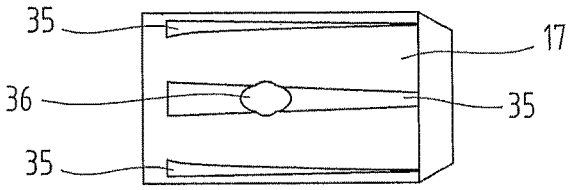
FIG. 46 shows a plan view of a half-shell of a housing of a light source according to the invention.

Shown in FIG. 46 is an embodiment of a half-shell 17 of plastic. Two of these half-shells are connected to one another, preferably by snap-fitting and/or adhesive bonding and/or welding, in particular by ultrasonic welding, to form the housing 3 (not represented in FIG. 46).

The half-shell 17 and the other half-shell (not represented here) may have ribs 35 on their outer sides. The ribs 35 may be conically formed and taper in the direction of an end face of the half-shells. Insertion of the housing into the holder 19 (not represented here) is facilitated by the form of the ribs 35. Here, the ribs 35 are pressed together (squeezed) and the housing 3 is fixed in the holder 19. The ribs 35 are formed in one piece with the half-shell 17. The half-shell 17 and the ribs 35 may for example be produced by injection molding. In FIG. 46, a feed point is provided with the reference numeral 36. The feed point 36 preferably does not project here, in order to make easy insertion of the housing 3 into the holder 19 possible.

Figure 47:
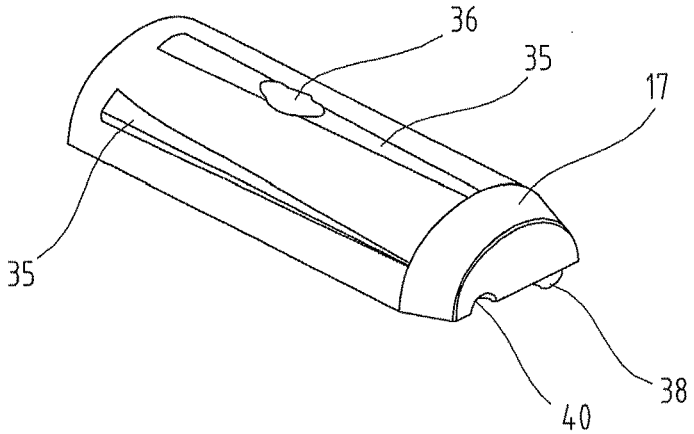
FIG. 47 shows a perspective view of the half-shell from FIG. 46.
Figure 49:
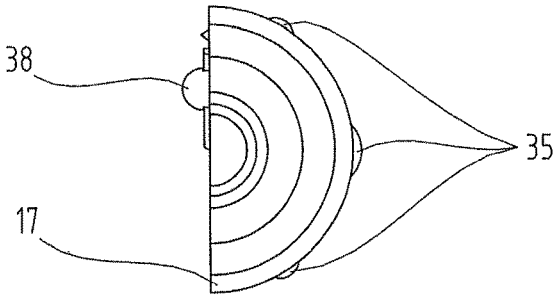
FIG. 49 shows a view from the front of the half-shell from FIG. 46.

As can be seen from FIGS. 47 and 49, the half-shell 17 may have an extension 38 (bulge) and/or a clearance 40. The other half-shell (not represented) has a clearance corresponding to the extension 38 and an extension that engages in the clearance 40. In this way, a self-centering or self-alignment of the half-shells in relation to one another can be achieved. It is of course also possible that the half-shell 17 only has extensions and the other half-shell only has clearances.

The hollow body 2 (not represented here) may be welded into the half-shells. In order to achieve exact positioning of the hollow body 2, (at least two) extensions 37 (welded ribs), which during welding adapt themselves to the contour of the hollow body 2, may be provided per half-shell, as represented in FIGS. 48 and 50.

Figure 48:
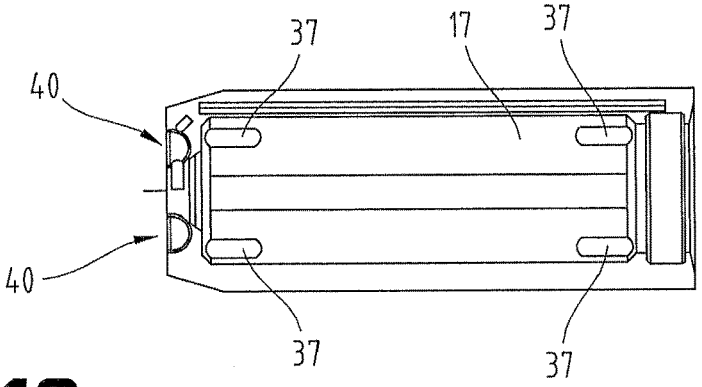
FIG. 48 shows a view from below of the half-shell from FIG. 46.
Figure 50:
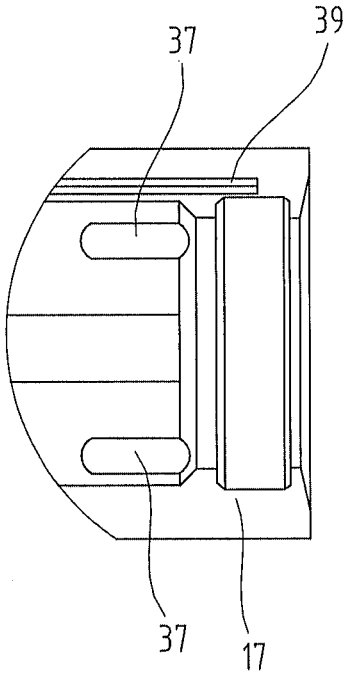
FIG. 50 shows a view of a detail of the region A from FIG. 48.
Figure 51:
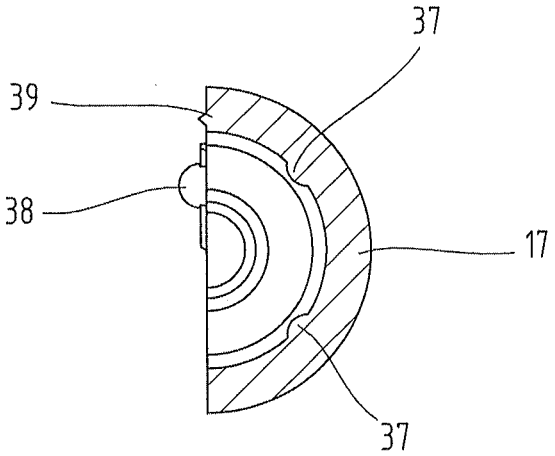
FIG. 51 shows a section along the line B-B in FIG. 48.

According to FIGS. 48, 50 and 51, on a connecting surface (contact surface) of the half-shell 17 in relation to the other half-shell (not shown) there may be arranged at least one rib 39, which projects from the connecting surface and provides an optimum transmission of energy between the half-shells during the (ultrasonic) welding operation.

The exemplary embodiments show possible configurational variants of the light source according to the invention and the arrangement according to the invention comprising a holder and a light source, it being noted at this stage that the invention is not restricted to the configurational variants thereof specifically represented, but rather that various combinations of the individual configurational variants with one another are also possible and, on the basis of the teaching for technical action provided by the present invention, this possibility of variation is within the ability of a person skilled in the art working in this technical field.

Furthermore, individual features or combinations of features from the various exemplary embodiments shown and described may also represent solutions that are in themselves independent, inventive or according to the invention.

The problems addressed by the independent inventive solutions can be taken from the description.

All of the indications of ranges of values in the present description should be understood as meaning that they include any and all subranges thereof; for example, the indication 1 to 10 should be understood as meaning that all of the subranges on the basis of the lower limit 1 and the upper limit 10 are included, i.e. all subranges begin with a lower limit of 1 or greater and end with an upper limit of 10 or less, for example 1 to 1.7, or 3.2 to 8.1, or 5.5 to 10.

For the sake of good order, it should finally be pointed out that, for better understanding of the construction of the light source according to the invention and the holder of the sighting device according to the invention, these and their component parts have sometimes been represented not to scale and/or enlarged and/or reduced in size.

| List of reference numerals | |
|---|---|
| 1 | Light source |
| 2 | Hollow body |
| 3 | Housing |
| 4 | Body |
| 5 | Protective covering |
| 6 | Holding cage |
| 7 | Holder |
| 8 | Portion |
| 9 | Extension |
| 10 | Holding element |
| 11 | Peripheral region |
| 12 | Holding element |
| 13 | Rear wall |
| 14 | Spring |
| 15 | Suction cup |
| 16 | Holding element |
| 17 | Half-shell |
| 18 | Half-shell |
| 19 | Holder |
| 20 | Housing |
| 21 | Bore |
| 22 | Shank |
| 23 | Head |
| 24 | Pin |
| 25 | Nut |
| 26 | Ring |
| 27 | Spring |
| 28 | O-ring |
| 29 | Collet |
| 30 | Snap ring |
| 31 | Squeezing ribs |
| 32 | Bead |
| 33 | Interface |
| 34 | Groove |
| 35 | Ribs |
| 36 | Feed point |
| 37 | Extension |
| 38 | Extension |
| 39 | Rib |
| 40 | Clearance |

The invention claimed is:

1. A light source, which has a hollow body closed in a gas-tight manner, which is coated on at least one inner side with a phosphor and is filled with gaseous tritium and emits light, the hollow body being arranged in a housing of the light source, wherein the light source has at least one body of a colored material which annularly encircles a longitudinal center axis of the light source and the color of which is different from black in daylight, the annularly encircling body being arranged at least on a terminal end region of the housing or at least between the terminal end region of the housing and at least one light-emitting end face of the hollow body, so that, in a plan view of the annularly encircling body and the hollow body along the longitudinal center plane of the light source, the end face of the hollow body appears as a bright, central point, which is surrounded by a colored ring, the colored ring being formed by an end face of the annularly encircling body that is facing away from the end face of the hollow body, wherein the light source has at least one protective covering of a transparent material, by which the at least one light-emitting end face of the hollow body is covered, wherein the annularly encircling body is part of a holder by which the protective covering is held in the housing, and wherein a peripheral region of a surface of the protective covering that is facing away from the hollow body lies against and is covered by the annularly encircling body.

2. The light source as claimed in claim 1, wherein the housing has on its inner side a highly reflective coating and/or the hollow body has on its outer side a highly reflective coating facing the interior of the hollow body.

3. The light source as claimed in claim 1, wherein the annularly encircling body covers a peripheral region of the light-emitting end face of the hollow body, a central region of the light-emitting end face being visible through a clear cross section of the annularly encircling body.

4. The light source as claimed in claim 1, wherein the annularly encircling body is printed on the protective covering or on the light-emitting end face of the hollow body or on the housing.

5. The light source as claimed in claim 1, wherein the annularly encircling body is part of a holding cage in which the hollow body is arranged, the holding cage being connected to an inner side of the housing.

6. The light source as claimed in claim 1, wherein the annularly encircling body is connected to or formed in one piece with a tubular portion projecting perpendicularly from it, the protective covering having side surfaces in the form of a cylindrical body, which are connected to the tubular portion projecting perpendicularly from the annular body.

7. The light source as claimed in claim 1, wherein the annularly encircling body is arranged on an outer side of the housing and connected to the housing by a press fit, the protective covering being clamped in the housing by means of the annularly encircling body.

8. The light source as claimed in claim 1, wherein in the housing there is arranged at least one holding element, which has a free end projecting into the interior of the housing and an end connected to the housing, the free end of the at least one holding element facing a surface of the protective covering J that is facing the hollow body or lying against said surface.

9. The light source as claimed in claim 8, wherein the at least one holding element is formed as a resilient tongue.

10. The light source as claimed in claim 1, wherein the protective covering has on its lateral peripheries holding portions in the form of clearances or extensions and the housing likewise has on its inner side holding portions in the form of clearances or extensions, the holding portions of the protective covering and the holding portions of the housing engaging in one another.

11. The light source as claimed in claim 1, wherein the housing has at least one encircling clearance, which receives a lateral body surface of the protective covering.

12. The light source as claimed in claim 1, wherein the housing has in a region of the terminal end region at least one peripheral region projecting in the direction of the longitudinal center line.

13. The light source as claimed in claim 1, wherein the hollow body is cemented, welded, clamped or cast in the housing.

14. The light source as claimed in claim 1, wherein in the housing there is arranged at least one holding element, which has a free end projecting into the interior of the housing and an end connected to the housing, the free end of the at least one holding element lying against a surface of the hollow body.

15. The light source as claimed in claim 1, wherein a spring that acts in the direction of the longitudinal center axis of the light source is arranged between a rear side of the hollow body that is facing away from the annularly encircling body and a rear wall of the housing.

16. The light source as claimed in claim 1, wherein a suction cup is arranged a rear side of the hollow body that is facing away from the annularly encircling body and a rear wall of the housing.

17. The light source as claimed in claim 1, wherein on the outer side of the housing there is arranged at least one holding element, which has a free end projecting from the housing and an end connected to the housing.

18. The light source as claimed in claim 1, wherein the housing is formed by two half-shells connected to one another.

19. A sighting device with a holder for the light source as claimed in claim 1, wherein the holder has a housing, the housing of the light source and the housing of the holder being connected to one another in a frictionally engaging and/or interlocking manner, wherein the housing of the light source and the housing of the holder are riveted to one another, there being arranged on a rear wall of the housing of the light source that is facing away from the light-emitting end face of the hollow body a shank of a rivet that passes through an opening in the housing of the holder, a head of the rivet being arranged on an outer side of the housing of the holder that is facing away from the housing of the light source and said head supporting itself against the outer side of the housing of the holder.

20. The sighting device as claimed in claim 19, wherein O-rings are arranged between the housing of the light source and the housing of the holder.

21. The sighting device as claimed in claim 19, wherein the housing of the holder has a bore with an internal thread, the housing of the light source having an external thread corresponding to the internal thread of the bore and the housing of the holder and the housing of the light source being screwed to one another.

22. The sighting device as claimed in claim 19, wherein the housing of the light source and the housing of the holder are connected to one another by way of a bayonet closure.

23. The sighting device as claimed in claim 19, wherein the housing of the light source has at least one groove on an outer side and the housing of the holder has at least one groove on an inner side, the housing of the light source and the housing of the holder being connected to one another by at least one pin engaging over a certain portion in the groove of the housing of the light source and over a certain portion in the groove of the housing of the holder.

24. The sighting device as claimed in claim 19, wherein the housing of the light source has on its outer side holding portions in the form of clearances or extensions and the housing of the holder likewise has on its inner side holding portions in the form of clearances or extensions, the holding portions of the housing of the light source and the holding portions of the housing of the holder engaging in one another.

25. The sighting device as claimed in claim 19, wherein the housing of the light source is arranged in a bore of the housing of the holder and is held in the housing of the holder by means of a nut tapering conically in a light-exiting direction.

26. The sighting device as claimed in claim 19, wherein the housing of the light source is conically formed and is pressed into a cylindrical bore of the housing of the holder.

27. The sighting device as claimed in claim 19, wherein the housing of the light source is held in the housing of the holder by means of at least one ring pressed in between the housing of the light source and the housing of the holder.

28. The light source as claimed in claim 1, wherein the housing has at least one interface for the connection to a holder for the light source.

29. The light source as claimed in claim 28, wherein the housing has on at least one portion of a body surface a clearance through which light emitted by the hollow body exits.

30. The light source as claimed in claim 28, wherein the hollow body and the housing each have at least one interface for the connection of the hollow body to the housing.

31. The light source as claimed in claim 30, wherein the at least one interface of the hollow body and the at least one interface of the housing form a magnetic closure.

32. The light source as claimed in claim 28, wherein the housing of the light source is formed by two half-shells of plastic, which are welded or adhesively bonded to one another are connected to one another by means of snap-fitting.

33. A holder for the light source as claimed in claim 28, wherein the holder has at least one interface for the connection to the housing of the light source.

34. An arrangement comprising the light source as claimed in claim 28 and a holder wherein the holder and the housing of the light source each have at least one interface, the at least one interface of the housing and the at least one interface of the holder being in engagement with one another in a connected state of the light source with the holder, and the light source and the holder being connected to one another in an interlocking and/or frictionally engaging manner, the at least one interface of the housing and the at least one interface of the holder in engagement therewith being releasable from one another, and wherein the at least one interface of the housing and the at least one interface of the holder form a bayonet closure.

35. The arrangement as claimed in claim 34, wherein the at least one interface of the housing and the at least one interface of the holder form a snap closure.

36. The arrangement as claimed in claim 34, wherein the at least one interface of the housing and the at least one interface of the holder form a screw closure.

37. The arrangement as claimed in claim 34, wherein the at least one interface of the housing and the at least one interface of the holder form a clamping closure.

38. The arrangement as claimed in claim 34, wherein the at least one interface of the housing and the at least one interface of the holder form a magnetic closure.

39. A light source, which has a hollow body closed in a gas-tight manner, which is coated on at least one inner side with a phosphor and is filled with gaseous tritium and emits light, the hollow body being arranged in a housing of the light source, wherein the light source has at least one body of a colored material which annularly encircles a longitudinal center axis of the light source and the color of which is different from black in daylight, the annularly encircling body being arranged at least on a terminal end region of the housing or at least between the terminal end region of the housing and at least one light-emitting end face of the hollow body, so that, in a plan view of the annularly encircling body and the hollow body along the longitudinal center plane of the light source, the end face of the hollow body appears as a bright, central point, which is surrounded by a colored ring, the colored ring being formed by an end face of the annularly encircling body that is facing away from the end face of the hollow body, wherein the housing has at least one interface for the connection to a holder for the light source, wherein the housing of the light source is formed by two half-shells of plastic, which are welded or adhesively bonded to one another or are connected to one another by means of snap-fitting, and wherein the housing ribs are provided on an outer side of at least one half-shell.

40. A light source, which has a hollow body closed in a gas-tight manner, which is coated on at least one inner side with a phosphor and is filled with gaseous tritium and emits light, the hollow body being arranged in a housing of the light source, wherein the light source has at least one body of a colored material which annularly encircles a longitudinal center axis of the light source and the color of which is different from black in daylight, the annularly encircling body being arranged at least on a terminal end region of the housing or at least between the terminal end region of the housing and at least one light-emitting end face of the hollow body, so that, in a plan view of the annularly encircling body and the hollow body along the longitudinal center plane of the light source, the end face of the hollow body appears as a bright, central point, which is surrounded by a colored ring, the colored ring being formed by an end face of the annularly encircling body that is facing away from the end face of the hollow body, wherein the housing has at least one interface for the connection to a holder for the light source, wherein the housing of the light source is formed by two half-shells of plastic, which are welded or adhesively bonded to one another or are connected to one another by means of snap-fitting, and wherein each half-shall has inwardly projecting extensions for fixing the hollow body.

41. A light source, which has a hollow body closed in a gas-tight manner, which is coated on at least one inner side with a phosphor and is filled with gaseous tritium and emits light, the hollow body being arranged in a housing of the light source, wherein the light source has at least one body of a colored material which annularly encircles a longitudinal center axis of the light source and the color of which is different from black in daylight, the annularly encircling body being arranged at least on a terminal end region of the housing or at least between the terminal end region of the housing and at least one light-emitting end face of the hollow body, so that, in a plan view of the annularly encircling body and the hollow body along the longitudinal center plane of the light source, the end face of the hollow body appears as a bright, central point, which is surrounded by a colored ring, the colored ring being formed by an end face of the annularly encircling body that is facing away from the end face of the hollow body, wherein the housing has at least one interface for the connection to a holder for the light source, wherein the housing of the light source is formed by two half-shells of plastic, which are welded or adhesively bonded to one another or are connected to one another by means of snap-fitting, and wherein at least one of the half-shells has at least one extension and at least a second of the half-shells has at least one clearance corresponding to the at least one extension.

42. A light source, which has a hollow body closed in a gas-tight manner, which is coated on at least one inner side with a phosphor and is filled with gaseous tritium and emits light, the hollow body being arranged in a housing of the light source, wherein the light source has at least one body of a colored material which annularly encircles a longitudinal center axis of the light source and the color of which is different from black in daylight, the annularly encircling body being arranged at least on a terminal end region of the housing or at least between the terminal end region of the housing and at least one light-emitting end face of the hollow body, so that, in a plan view of the annularly encircling body and the hollow body along the longitudinal center plane of the light source, the end face of the hollow body appears as a bright, central point, which is surrounded by a colored ring, the colored ring being formed by an end face of the annularly encircling body that is facing away from the end face of the hollow body, wherein the housing has at least one interface for the connection to a holder for the light source, wherein the housing of the light source is formed by two half-shells of plastic, which are welded or adhesively bonded to one another or are connected to one another by means of snap-fitting, and wherein at least a first of the half-shells has on a connecting surface in relation to the other half-shell at least one rib projecting from the connecting surface.

* * * * *